US011155282B2

(12) United States Patent
Li et al.

(10) Patent No.: US 11,155,282 B2
(45) Date of Patent: Oct. 26, 2021

(54) BOGIE FRAME, BOGIE ASSEMBLY AND RAIL VEHICLE

(71) Applicant: BYD COMPANY LIMITED, Guangdong (CN)

(72) Inventors: Daolin Li, Shenzhen (CN); Huiyue Liu, Shenzhen (CN); Zhicheng Tan, Shenzhen (CN); Qihua Feng, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 372 days.

(21) Appl. No.: 16/335,227

(22) PCT Filed: Feb. 28, 2017

(86) PCT No.: PCT/CN2017/075224
§ 371 (c)(1),
(2) Date: Mar. 20, 2019

(87) PCT Pub. No.: WO2018/054017
PCT Pub. Date: Mar. 29, 2018

(65) Prior Publication Data

US 2019/0248385 A1 Aug. 15, 2019

(30) Foreign Application Priority Data

Sep. 21, 2016 (CN) ..... 201610839741.8
Sep. 21, 2016 (CN) ..... 201610840410.6

(51) Int. Cl.
*B61F 5/52* (2006.01)
*B61B 13/04* (2006.01)
*B61F 5/02* (2006.01)

(52) U.S. Cl.
CPC ..... *B61F 5/52* (2013.01); *B61B 13/04* (2013.01); *B61F 5/02* (2013.01)

(58) Field of Classification Search
CPC ..... B61F 5/52; B61F 5/00; B61F 5/02; B61B 13/04
See application file for complete search history.

(56) References Cited

U.S. PATENT DOCUMENTS 6,523,481 B2 * 2/2003 Hara ..... B61C 13/00 104/245
7,823,512 B2 * 11/2010 Timan ..... B61B 13/04 105/144

(Continued)

FOREIGN PATENT DOCUMENTS

CN 201296254 Y 8/2009
CN 201777260 U 3/2011

(Continued)

OTHER PUBLICATIONS

Search Report for European Application No. 17852096.1, dated Nov. 6, 2019, 9 pages.

(Continued)

*Primary Examiner* — Jason C Smith

(57) ABSTRACT

The present disclosure provides a bogie frame, a bogie assembly and a rail vehicle. The bogie frame includes a bogie body, the bogie body being substantially rectangular and including a first connecting beam, a second connecting beam, a third connecting beam and a fourth connecting beam which are sequentially connected end to end, where the first connecting beam is opposite to the third connecting beam, the second connecting beam is opposite to the fourth connecting beam, an electric assembly mounting groove is formed in the fourth connecting beam, the thickness of the fourth connecting beam is greater than the thickness of the second connecting beam, and the top wall of the first connecting beam and the top wall of the third connecting (Continued)

beam are connected between the top wall of the second connecting beam and the top wall of the fourth connecting beam in an arc shape.

20 Claims, 10 Drawing Sheets

(56) References Cited

U.S. PATENT DOCUMENTS

| | | | | |
|---|---|---|---|---|
| 8,316,775 | B2 * | 11/2012 | Timan | B61B 13/04 105/144 |
| 2009/0266268 | A1 * | 10/2009 | Timan | B61B 13/04 105/157.1 |
| 2019/0210620 | A1 * | 7/2019 | Li | B61C 9/50 |
| 2019/0248385 | A1 * | 8/2019 | Li | B61F 5/52 |

FOREIGN PATENT DOCUMENTS

| | | | |
|---|---|---|---|
| CN | 201849478 | U | 6/2011 |
| CN | 201923162 | U | 8/2011 |
| CN | 102358293 | A | 2/2012 |
| CN | 202294848 | U | 7/2012 |
| CN | 202879514 | U | 4/2013 |
| CN | 203372254 | U | 1/2014 |
| CN | 103625493 | A | 3/2014 |
| CN | 203580981 | U | 5/2014 |
| CN | 203727402 | U | 7/2014 |
| CN | 204279635 | U | 4/2015 |
| CN | 104608788 | A | 5/2015 |
| CN | 105059307 | A | 11/2015 |
| CN | 204915705 | U | 12/2015 |
| CN | 204978684 | U | 1/2016 |
| CN | 105438211 | A | 3/2016 |
| CN | 105905120 | A | 8/2016 |
| JP | H10258735 | A | 9/1998 |
| KR | 1020110017369 | A | 2/2011 |
| KR | 1020130099469 | A | 9/2013 |
| WO | 2015/024745 | A1 | 2/2015 |

OTHER PUBLICATIONS

Office Action for European Application No. 17852096.1, dated Aug. 9, 2019, 4 pages.

Korea Office Action for Application No. 10-2019-7008280, dated Feb. 21, 2020, 8 pages.

PCT International Search Report and the Written Opinion dated May 16, 2017, issued in related International Application No. PCT/CN2017/075224 (8 pages).

* cited by examiner

A

BOGIE FRAME, BOGIE ASSEMBLY AND RAIL VEHICLE

CROSS-REFERENCE TO RELATED APPLICATIONS

This application is a national phase application of International Application No. PCT/CN2017/075224, filed on Feb. 28, 2017, which is based on and claims priority to and benefits of Chinese Patent Applications No. 201610839741.8 and No. 201610840410.6, both filed with the State Intellectual Property Office (SIPO) of the People's Republic China on Sep. 21, 2016. The entire contents of the above-identified applications are incorporated herein by reference.

FIELD

The present disclosure relates to the technical field of rail vehicles and particularly relates to a bogie frame, a bogie assembly and a rail vehicle with the bogie assembly.

BACKGROUND

In related technologies, a rail vehicle includes an electric assembly and a bogie frame, and the bogie frame is provided with an electric assembly mounting groove for containing the electric assembly. Because the thicknesses of all parts of the bogie frame are basically identical, the structural strength of the electric assembly mounting groove is poor, the electric assembly is easy to deform, which results in poor fixation reliability of the electric assembly.

SUMMARY

The present disclosure aims at resolving one of technical problems in related technologies at least to some extent. Therefore, the embodiments of the present disclosure provide a bogie frame, and the bogie frame has high structural strength, which can ensure the mounting reliability of the electric assembly at the electric assembly mounting groove.

The embodiments of the present disclosure further provide a bogie assembly.

The embodiments of the present disclosure further provide a vehicle.

The bogie frame according to the embodiments of the present disclosure includes a bogie body, the bogie body is substantially rectangular and includes a first connecting beam, a second connecting beam, a third connecting beam and a fourth connecting beam which are sequentially connected end to end, the first connecting beam is opposite to the third connecting beam, the second connecting beam is opposite to the fourth connecting beam, an electric assembly mounting groove is formed in the fourth connecting beam, the thickness of the fourth connecting beam is greater than the thickness of the second connecting beam, and the top wall of the first connecting beam and the top wall of the third connecting beam are connected between the top wall of the second connecting beam and the top wall of the fourth connecting beam in an arc shape.

In the bogie frame according to the embodiments of the present disclosure, because the electric assembly mounting groove is formed in the fourth connecting beam, an electric assembly is mounted on the fourth connecting beam. The structural strength of the fourth connecting beam is enhanced by reasonably increasing the thickness of the fourth connecting beam, so that the electric assembly can be reliably fixed on the fourth connecting beam to enhance the structural reliability of the bogie assembly. Furthermore, the top wall of the fourth connecting beam is in smooth connection and transition with the top wall of the second connecting beam under the condition that the top wall of the fourth connecting beam is higher than the top wall of the second connecting beam, so that the electric assembly can be better fixed on the bogie body.

In addition, the bogie frame according to the embodiments of the present disclosure can also have the following additional technical features:

In some examples of the present disclosure, the bottom walls of the first connecting beam, the second connecting beam, the third connecting beam and the fourth connecting beam are positioned on the same plane.

In some examples of the present disclosure, each of the first connecting beam, the second connecting beam, the third connecting beam and the fourth connecting beam includes an outer side wall and an inner side wall, the outer side wall and the inner side wall connect the top wall and the bottom wall and are spaced apart in in-and-out directions, and a connecting beam reinforcing rib is also connected between the outer side wall and the inner side wall.

In some examples of the present disclosure, the top wall of the first connecting beam, the top wall of the second connecting beam and the top wall of the third connecting beam are of a split structure, the top wall of the fourth connecting beam includes two sections positioned at two sides of the electric assembly mounting groove, and the two sections of the top wall of the fourth connecting beam are integrally formed with the top wall of the first connecting beam and the top wall of the third connecting beam respectively.

In some examples of the present disclosure, the bogie frame also includes a suspension support seat connected to the bogie body, the suspension support seat is substantially in a horizontal state, and smooth transition is adopted between the bogie body and the suspension support seat.

In some examples of the present disclosure, two suspension support seats are arranged and are respectively connected to two opposite sides of the bogie body, and define a rail recess together with the bogie body.

In some examples of the present disclosure, the two suspension support seats are respectively connected to the second connecting beam and the fourth connecting beam, the distance between the upper surface of the second connecting beam and the upper surface of the corresponding suspension support seat is 480 millimeter (mm) to 660 mm, and the distance between the upper surface of the fourth connecting beam and the upper surface of the corresponding suspension support seat is 620 mm to 800 mm.

In some examples of the present disclosure, the lower surface of the connected portion between the suspension support seat and the bogie body is provided with a plurality of connecting reinforcing ribs spaced apart.

In some examples of the present disclosure, the bogie frame is provided with a horizontal wheel mounting seat, and the bogie frame is also provided with a horizontal wheel mounting seat reinforcing rib corresponding to the horizontal wheel mounting seat.

In some examples of the present disclosure, the bogie frame also includes an electric assembly protection cover, and the electric assembly protection cover is mounted above the fourth connecting beam and is in an arched shape so as to cover the electric assembly mounting groove.

The bogie assembly according to the embodiments of the present disclosure includes the bogie frame according to the above embodiments of the present disclosure.

The bogie assembly according to the embodiments of the present disclosure and the bogie frame according to the embodiments of the present disclosure have the same beneficial effects, and will not be described in detail herein.

In addition, the bogie assembly according to the embodiments of the present disclosure can also have the following additional technical features:

In some examples of the present disclosure, the bogie frame also includes a suspension support seat connected to the bogie body, a running wheel mounting groove is also formed in the bogie body, the first connecting beam and the third connecting beam are provided with guide wheel mounting seats, and the suspension support seat is provided with a steady wheel mounting seat.

In some examples of the present disclosure, the bogie assembly also includes a running wheel which is rotationally mounted in the running wheel mounting groove; an electric assembly which is mounted in the electric assembly mounting groove and drives the running wheel to rotate; a suspension system which is mounted on the suspension support seat; a guide wheel which is mounted on the guide wheel mounting seat; a steady wheel which is mounted on the steady wheel mounting seat; a traction mechanism which is connected between the bogie frame and a vehicle body so as to haul the vehicle body.

In some examples of the present disclosure, two suspension support seats are arranged and are respectively connected to the second connecting beam and the fourth connecting beam, the first connecting beam, the second connecting beam, the third connecting beam, the fourth connecting beam and the two suspension support seats define the rail recess together, two suspension systems are arranged and are symmetrically distributed with respect to the center of the bogie frame, and the two suspension systems are in one-to-one correspondence to the two suspension support seats respectively.

In some examples of the present disclosure, an axial restrict component and a radial restrict component are arranged at the electric assembly mounting groove, and the electric assembly is fixedly connected to the axial restrict component and the radial restrict component.

In some examples of the present disclosure, the axial restrict component is of a plate structure and is perpendicular to the axis of the electric assembly, the axial restrict component is substantially in a U shape, and a plurality of mounting holes are distributed in the extended direction thereof; two radial restrict components are arranged and are respectively of a plate structure, and the two radial restrict components are respectively positioned at two sides of the electric assembly and are respectively provided with mounting holes.

In some examples of the present disclosure, the suspension system includes a vehicle body connecting seat, an elastic component, a transverse damper and a vertical damper, the vehicle body connecting seat is positioned above the suspension support seat, the elastic component is connected between the vehicle body connecting seat and the suspension support seat, the transverse damper is hinged between the vehicle body connecting seat and the bogie body, and the vertical damper is hinged between the vehicle body connecting seat and the suspension support seat.

In some examples of the present disclosure, the vehicle body connecting seat includes an upper plate, suitable for being connected to the vehicle body; a web plate, positioned below the upper plate and connected to the upper plate; a lower plate, positioned below the web plate and connected to the web plate, wherein the surface of the upper plate facing the vehicle body is provided with a buffer cushion.

In some examples of the present disclosure, two web plates are arranged and are respectively a long web plate and a short web plate with different lengths, one end of the long web plate is hinged to the transverse damper, the other end of the long web plate and one end of the short web plate are both hinged to the vertical damper, and the one end of the short web plate is adjacent to the other end of the long web plate.

In some examples of the present disclosure, the surface of the short web plate facing away from the long web plate is provided with a suspension stop component, the suspension stop component includes a rubber cushion, the bogie body is provided with a transverse stop mounting seat, and the transverse stop mounting seat is corresponding to the suspension stop component and is suitable for matching with the suspension stop component.

In some examples of the present disclosure, the suspension system also includes an elastic component restrict bracket, and the elastic component restrict bracket is connected between the vehicle body connecting seat and the suspension support seat.

In some examples of the present disclosure, the upper end of the elastic component restrict bracket is hinged to the vehicle body connecting seat, the lower end of the elastic component restrict bracket is fixedly connected to the suspension support seat through a fastener, a damping cushion is arranged at the lower end of the elastic component restrict bracket, the damping cushion is positioned between the elastic component restrict bracket and the suspension support seat, and the fastener penetrates through the damping cushion.

In some examples of the present disclosure, the end surface of the bottom wall of the electric assembly mounting groove facing away from the electric assembly is provided with a reinforcing structure, and the reinforcing structure is a plurality of reinforcing ribs.

In some examples of the present disclosure, the reinforcing ribs include vertical reinforcing ribs and inclined reinforcing ribs, the vertical reinforcing ribs are perpendicular to the bottom wall of the electric assembly mounting groove, and the inclined reinforcing ribs are inclined with respect to the bottom wall of the electric assembly mounting groove.

In some examples of the present disclosure, two vertical reinforcing ribs and two inclined reinforcing ribs are arranged, the two vertical reinforcing ribs are arranged between the two inclined reinforcing ribs, and the two inclined reinforcing ribs are respectively arranged close to two edges of the bottom wall of the electric assembly mounting groove.

In some examples of the present disclosure, a guide wheel adjusting shim is arranged between the guide wheel and the guide wheel mounting seat, and a steady wheel adjusting shim is arranged between the steady wheel and the steady wheel mounting seat.

In some examples of the present disclosure, the height of the steady wheel is less than the height of the guide wheel, the diameter of the steady wheel is greater than the diameter of the guide wheel, and the central axis of the steady wheel is positioned at the outer side of the central axis of the guide wheel.

The rail vehicle according to the embodiments of the present disclosure includes a vehicle body; and a bogie assembly according to the above embodiments of the present disclosure, wherein the vehicle body is mounted on the bogie assembly.

The rail vehicle according to the embodiments of the present disclosure and the bogie assembly according to the embodiments of the present disclosure have the same beneficial effects, and will not be described in detail herein.

Figure 1:
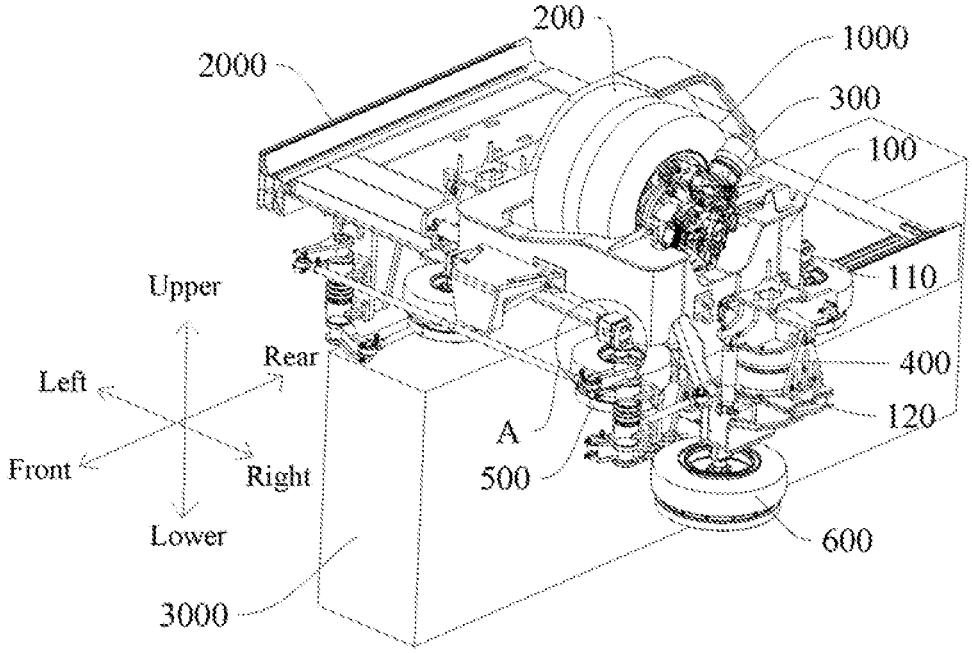
FIG. 1 is a schematic of a bogie assembly, a vehicle body and a rail beam according to the embodiments of the present disclosure.

REFERENCE NUMERALS bogie assembly 1000;

bogie frame 100; running wheel mounting groove 101; electric assembly mounting groove 102; axial restrict component 103; radial restrict component 104; radial restrict component reinforcing rib 105; rail recess 106; reinforcing rib 107 of electric assembly mounting groove 102; vertical reinforcing rib 108; inclined reinforcing rib 109;

bogie body 110; transverse stop mounting seat 111; first connecting beam 112; second connecting beam 113; third connecting beam 114; fourth connecting beam 115; dodging groove 116 of bogie body 110; connecting beam reinforcing rib 117; horizontal wheel mounting seat reinforcing rib 118; top wall 112*a* of first connecting beam 112; bottom wall 112*b* of first connecting beam 112; outer side wall 112*c* of first connecting beam 112; inner side wall 112*d* of first connecting beam 112;

suspension support seat 120; connecting reinforcing rib 121; guide wheel mounting seat 130; second pre-positioning component 131 of guide wheel mounting seat 130; steady wheel mounting seat 140; electric assembly protection cover 150;

running wheel 200; electric assembly 300;

suspension system 400; vehicle body connecting seat 410; suspension stop component 411; upper plate 412; lower plate 413; buffer cushion 414; long web plate 415; short web plate 416;

elastic component 420; transverse damper 430; vertical damper 440; elastic component restrict bracket 450; damping cushion 451; restrict component body 452; restrict component bottom plate 453;

guide wheel 500; guide wheel adjusting shim 510; guide wheel mounting block 520; first pre-positioning component 521 of guide wheel mounting block 520;

steady wheel 600; steady wheel mounting block 610;

vehicle body 2000; and rail beam 3000.

DETAILED DESCRIPTION

The embodiments of the present disclosure are described in detail below. Examples of the embodiments are illustrated in the accompanying drawings. The embodiments described below with reference to the accompanying drawings are exemplary, and are used for explaining rather than limiting the present disclosure.

The bogie assembly 1000 according to the embodiments of the present disclosure is described in detail below with reference to the accompanying drawings. The bogie assembly 1000 can be applied to a rail vehicle, the rail vehicle also includes a vehicle body 2000, the vehicle body 2000 is mounted on the bogie assembly 1000, the rail vehicle can straddle on a single-track rail beam 3000 through the bogie assembly 1000, and the rail vehicle and the rail beam 3000 can form a part of a rail traffic system.

As shown in FIG. 1 to FIG. 4, the bogie assembly 1000 may include a bogie frame 100, a suspension system 400, a running wheel 200, an electric assembly 300, a guide wheel 500, a steady wheel 600 and a traction mechanism, a rail recess 106 is formed on the bogie frame 100, and the rail recess 106 is matched on the rail beam 3000.

The bogie frame 100 may include a bogie body 110 and a suspension support seat 120 connected to the bogie body 110, the suspension systems 400 may be mounted between the suspension support seat 120 and the vehicle body 2000, and the bogie body 110 of the bogie frame 100 may be provided with a running wheel mounting groove 101 and an electric assembly mounting groove 102. The running wheel 200 is rotationally mounted in the running wheel mounting groove 101. That is, the running wheel 200 can rotate with respect to the bogie frame 100 and the rail beam 3000. The electric assembly 300 is mounted in the electric assembly mounting groove 102, and the electric assembly 300 drives the running wheel 200 to rotate to achieve the travel of the rail vehicle. The electric assembly 300 includes a motor assembly and a speed reducer, and the power output from the motor assembly is transmitted to the running wheel 200 through the speed reducer.

The guide wheel 500 is mounted on the bogie body 110, and the steady wheel 600 is mounted on the suspension support seat 120. A plurality of guide wheels 500 are provided and respectively arranged at two sides of the rail beam 3000, a plurality of steady wheels 600 are provided and respectively arranged at two sides of the rail beam 3000, and the peripheral surfaces of the guide wheel 500 and the steady wheel 600 abut against the rail beam 3000. In other words, when the rail vehicle is in a traveling state, the guide wheel 500 and the steady wheel 600 roll with respect to the rail beam 3000, the guide wheel 500 can play a guiding role, and the steady wheel 600 can improve the traveling stability of the rail vehicle on the rail beam 3000, so that the guide wheel 500 and the steady wheel 600 enable the rail vehicle to travel stably and reliably.

The traction mechanism is connected between the bogie frame 100 and the vehicle body 2000, and the bogie frame 100 can haul the vehicle body 2000 to move through the traction mechanism, so that the rail vehicle can travel on the rail beam 3000.

The bogie frame 100 is firstly described below.

The bogie frame 100 includes a bogie body 110 and a suspension support seat 120. In some embodiments of the present disclosure, two suspension support seats 120 are arranged and connected to two opposite sides of the bogie body 110, and define a rail recess 106 together with the bogie body.

Figure 4:
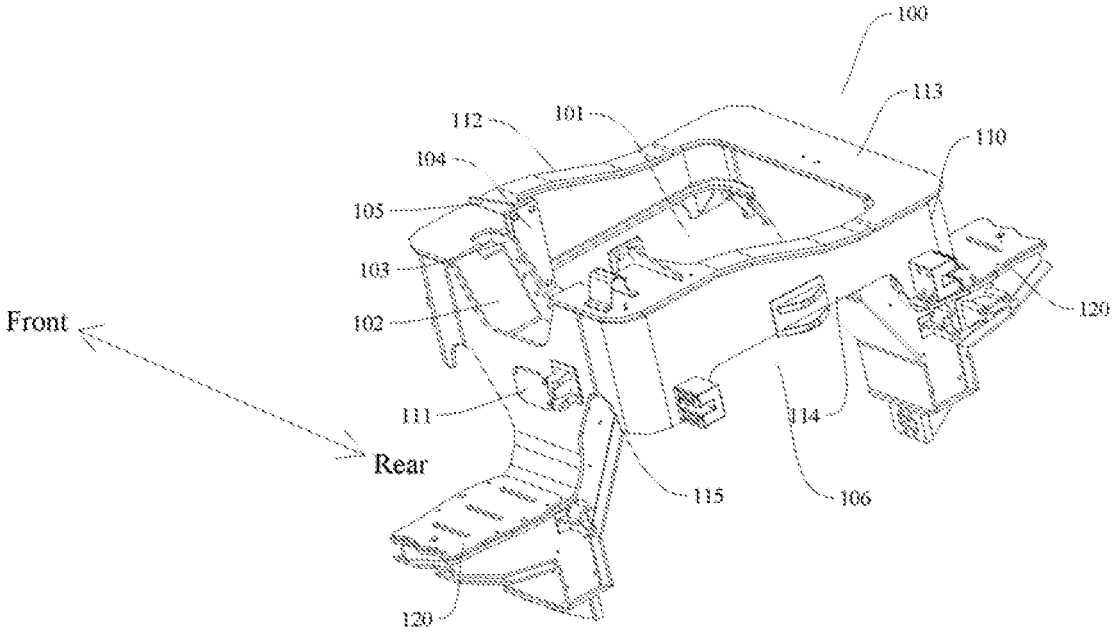
FIG. 4 is a three-dimensional view of the bogie frame.
Figure 6:
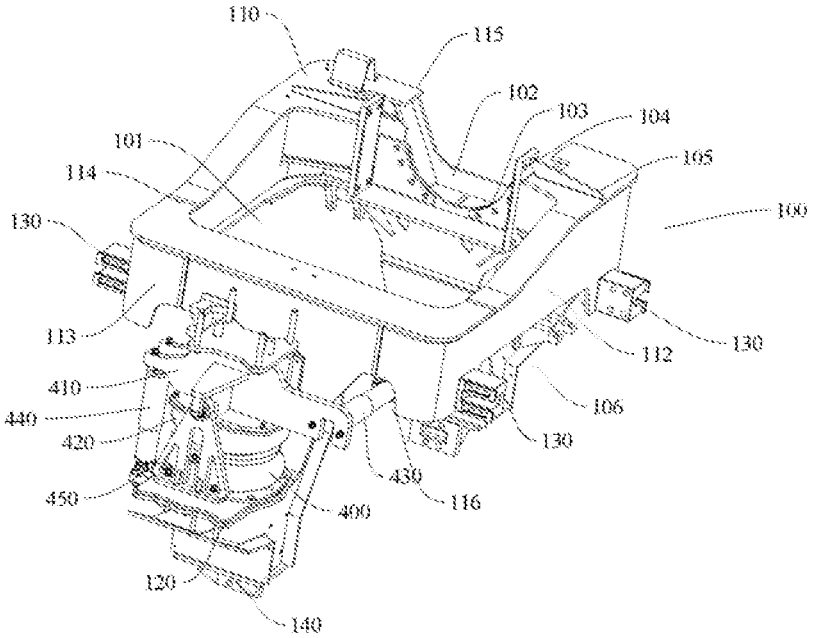
FIG. 6 is a three-dimensional view of the bogie frame and a suspension system.

As shown in FIG. 4 and FIG. 6, the bogie body 110 is substantially rectangular, the bogie body 110 may include a plurality of connecting beams which are connected end to end, and a middle region defined by the plurality of connecting beams is formed as a running wheel mounting groove 101. In some embodiments of the present disclosure, the bogie body 110 includes a first connecting beam 112, a second connecting beam 113, a third connecting beam 114 and a fourth connecting beam 115 which are sequentially connected end to end, the first connecting beam 112 and the third connecting beam 114 are oppositely arranged, and the second connecting beam 113 and the fourth connecting beam 115 are oppositely arranged.

Figure 9:
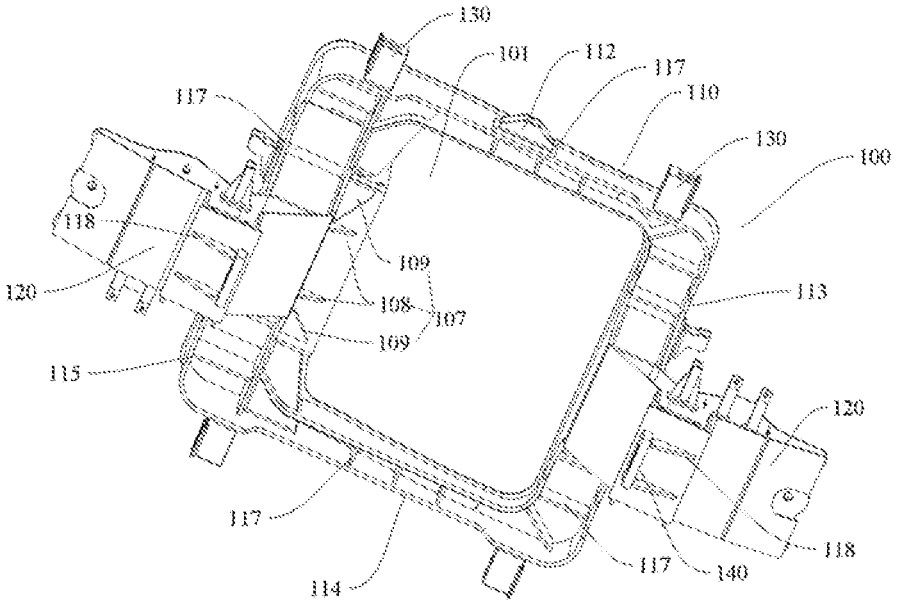
FIG. 9 is a three-dimensional view of the bogie frame.

As shown in FIG. 9, the first connecting beam 112, the second connecting beam 113, the third connecting beam 114 and the fourth connecting beam 115 are provided with connecting beam reinforcing ribs 117. The connecting beam reinforcing rib 117 can enhance the structural strength of the corresponding connecting beam, so that the structural strength of the bogie body 110 can be enhanced, and the structural reliability of the bogie assembly 1000 can be further enhanced.

The electric assembly mounting groove 102 is formed in the fourth connecting beam 115. For example, the electric assembly mounting groove 102 can be formed in the middle of the fourth connecting beam 115. The upper end of the electric assembly mounting groove 102 is open, so that the electric assembly 300 can be conveniently mounted in the electric assembly mounting groove 102. Furthermore, the electric assembly mounting groove 102 is linked with the running wheel mounting groove 101, so as to facilitate the connection between the electric assembly 300 and the running wheel 200. In some embodiments of the present disclosure, the shape of the electric assembly mounting groove 102 is adaptive to the shape of the lower half of the electric assembly 300.

Figure 16:
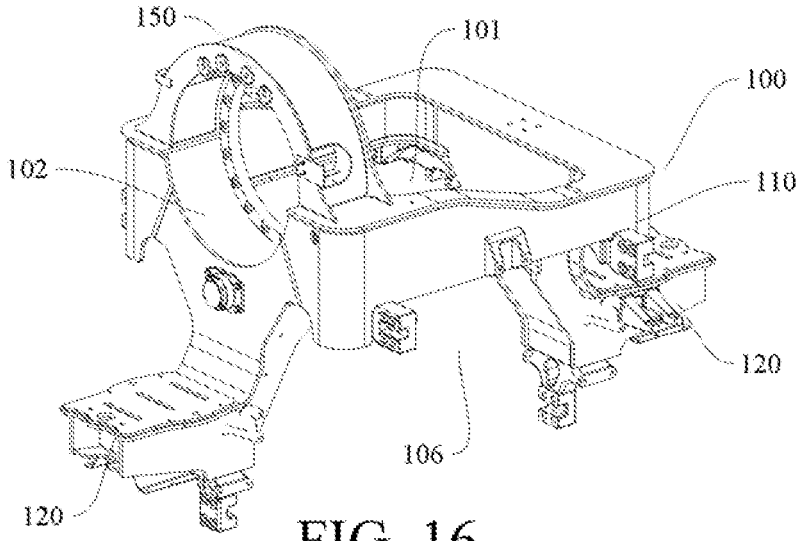
FIG. 16 is a schematic of the bogie frame with an electric assembly protection cover.
Figure 17:
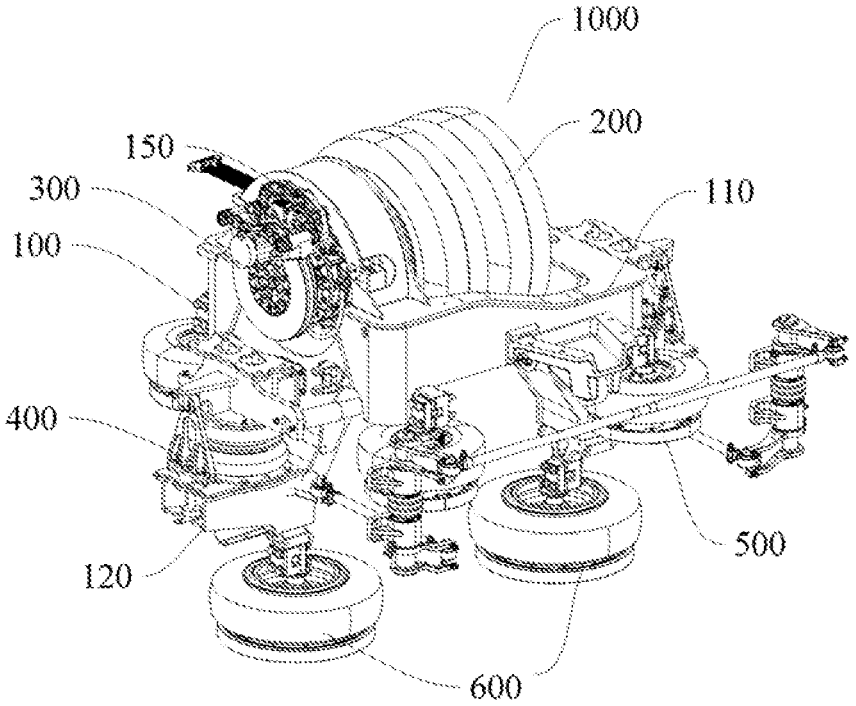
FIG. 17 is a schematic of the bogie assembly with the electric assembly protection cover.
Figure 18:
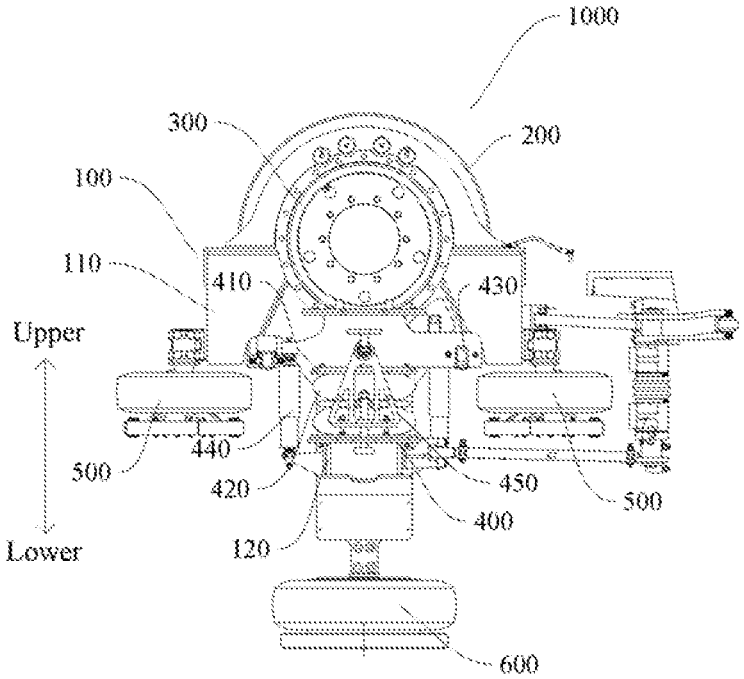
FIG. 18 is a side view of the bogie assembly with the electric assembly protection cover.

As shown in FIG. 16, FIG. 17 and FIG. 18, the bogie frame 100 also includes an electric assembly protection cover 150, the electric assembly protection cover 150 is mounted above the fourth connecting beam 115, and the electric assembly protection cover 150 is in an arched shape so as to cover the electric assembly mounting groove 102. When the electric assembly 300 is mounted on the electric assembly mounting groove 102, the electric assembly protection cover 150 can cover the electric assembly 300, so that the electric assembly protection cover 150 can effectively protect the electric assembly 300 to prevent components at the vehicle body 2000 above the electric assembly 300 from interfering with or disturbing the electric assembly 300, and further, the operating reliability of the electric assembly 300 can be better ensured.

Figure 5:
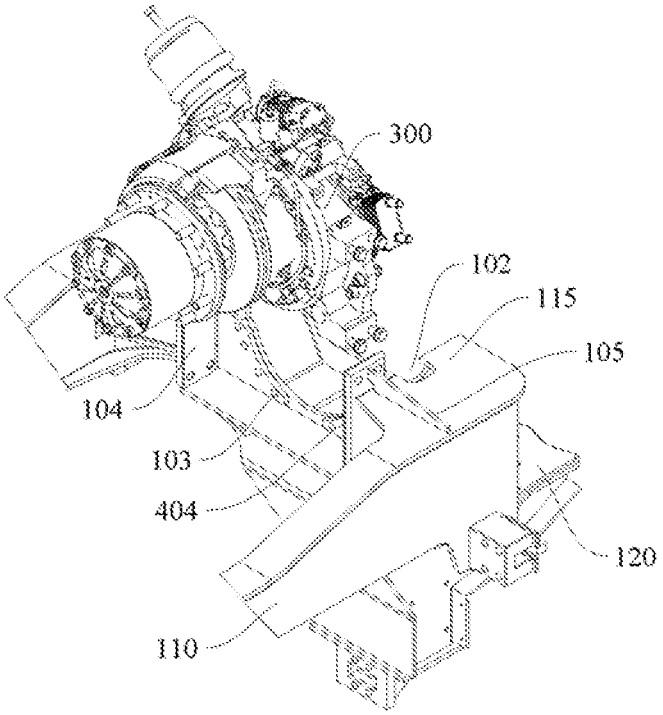
FIG. 5 is a partial schematic diagram of the electric assembly and the bogie frame.

As shown in FIG. 4 and FIG. 5, the electric assembly mounting groove 102 can be provided with an axial restrict component 103 and a radial restrict component 104, and the electric assembly 300 is fixedly connected to the axial restrict component 103 and the radial restrict component 104. The axial direction of the electric assembly 300 is the left-and-right direction as shown in FIG. 1, the axial restrict component 103 can limit the axial degree of freedom of the electric assembly 300, and the radial restrict component 104 can limit the radial degree of freedom of the electric assembly 300. It can be understood that when the rail vehicle travels on the rail beam 3000, the electric assembly 300 has a tendency of moving in the front-and-rear direction or the left-and-right direction relative to the bogie body 110 under the force, and the axial restrict component 103 and the radial restrict component 104 can ensure the mounting reliability of the electric assembly 300 in the electric assembly mounting groove 102 in the bogie frame 100, so that the structural reliability of the bogie assembly 1000 can be ensured.

As shown in FIG. 4 and FIG. 5, the axial restrict component 103 may be of a plate structure, the axial restrict component 103 is perpendicular to the axis of the electric assembly 300, the axial restrict component 103 is substantially in a U shape, the U-shaped axial restrict component 103 corresponds to and is matched with the mounting plate of the electric assembly 300, and a plurality of mounting holes are distributed in the extended direction (front-and-rear direction as shown in FIG. 4) of the axial restrict component 103. The axial restrict component 103 can be fixedly connected to the electric assembly 300 through a fastener, the fastener may include a bolt and a nut, and the bolt can penetrate through the mounting hole in the electric assembly 300 and the mounting hole in the axial restrict component 103 and then is in connection with the threaded nut, so that the axial restrict component 103 and the electric assembly 300 can be mutually fixed. Because the axial restrict component 103 is perpendicular to the axis of the electric assembly 300, when the electric assembly 300 has a tendency of moving in the left-and-right direction, the axial restrict component 103 can prevent the tendency promptly so as to ensure the mounting reliability of the electric assembly 300 in the electric assembly mounting groove 102.

As shown in FIG. 4 and FIG. 5, the radial restrict components 104 may be of a plate structure, two radial restrict components 104 may be arranged and are respectively positioned at two sides of the electric assembly 300, and the two radial restrict components 104 are respectively provided with mounting holes. Each radial restrict component 104 can extend in the up-and-down direction, each radial restrict component 104 is provided with two sets of mounting holes spaced apart up and down, and the number of each set of mounting holes is two. The platy radial restrict component 104 can be fixedly connected to the electric assembly 300 conveniently. In some embodiments of the present disclosure, the two radial restrict components 104 are symmetrically arranged with respect to the axis of the electric assembly 300, so that the mounting reliability of the electric assembly 300 in the electric assembly mounting groove 102 can be enhanced.

In order to be fixedly connected to the electric assembly 300, the radial restrict component 104 extends upwards beyond the upper surface of the bogie frame 100. Furthermore, in order to ensure the reliability of the portion of the radial restrict component 104 beyond the upper surface of the bogie frame 100, in the embodiments as shown in FIG. 4 and FIG. 5, the upper surface of the bogie frame 100 is provided with a radial restrict component reinforcing rib 105 connected to the portion of the radial restrict component 104 beyond the upper surface of the bogie frame 100. The radial restrict component reinforcing rib 105 is configured to be platy, and the radial restrict component reinforcing rib 105 is perpendicular to the radial restrict component 104, so that the radial restrict component reinforcing rib 105 can better support and fix the radial restrict component 104.

The thickness of the fourth connecting beam 115 may be greater than the thickness of the second connecting beam 113. Because the electric assembly mounting groove 102 is formed in the fourth connecting beam 115, the electric assembly 300 is mounted on the fourth connecting beam 115. Under such a condition, the structural strength of the fourth connecting beam 115 can be enhanced by reasonably increasing the thickness of the fourth connecting beam 115, so that the fourth connecting beam 115 can reliably fix the electric assembly 300, and further, the structural reliability of the bogie assembly 1000 can be enhanced.

In some embodiments of the present disclosure, there are two suspension support seats 120. The two suspension support seats 120 are respectively connected below the second connecting beam 113 and the fourth connecting beam 115, the distance between the upper surface of the second connecting beam 113 and the upper surface of the corresponding suspension support seat 120 is 480 mm to 660 mm, and the distance between the upper surface of the fourth connecting beam 115 and the upper surface of the corresponding suspension support seat 120 is 620 mm to 800 mm. In some embodiments of the present disclosure, the distance between the upper surface of the second connecting beam 113 and the upper surface of the corresponding suspension support seat 120 is 623 mm, and the distance between the upper surface of the fourth connecting beam 115 and the upper surface of the corresponding suspension support seat 120 is 759 mm. Therefore, the floor surface of the vehicle body 2000 is lower than the rotation axis of the running wheel 200 so as to enhance the traveling stability of the rail vehicle.

Figure 11:
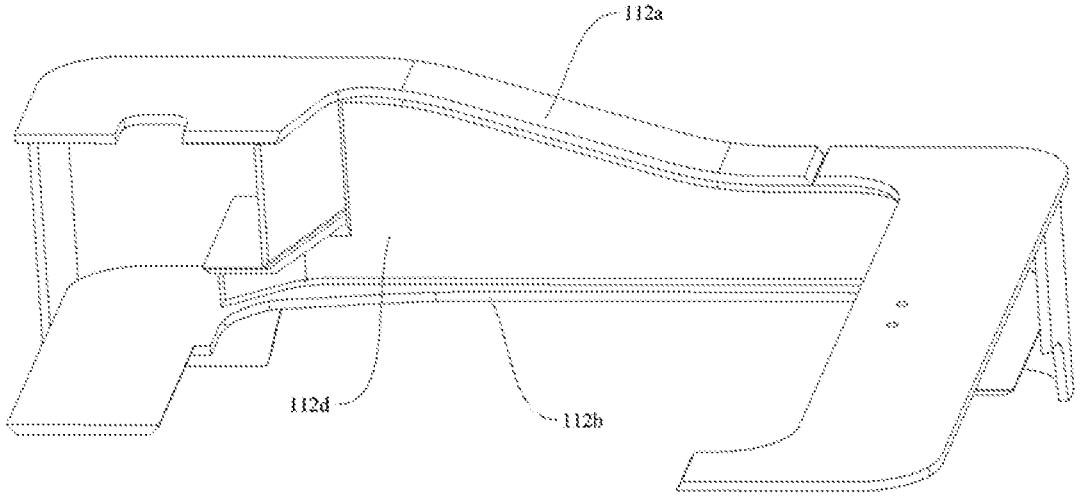
FIG. 11 is a partial schematic of the bogie frame.
Figure 12:
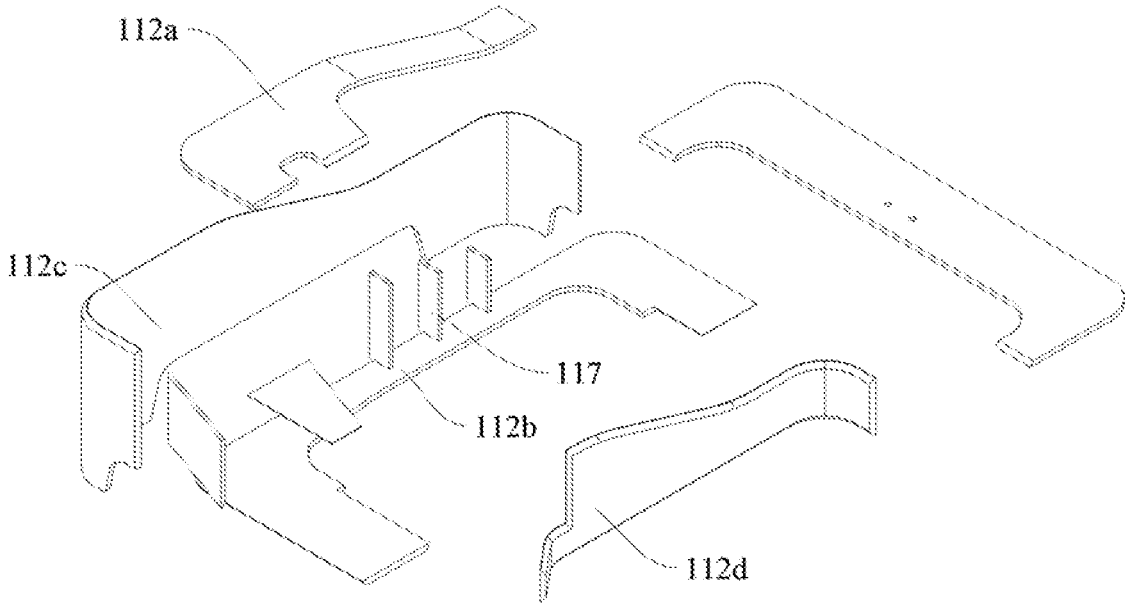
FIG. 12 is a partial exploded view of the bogie frame.

In the embodiments of the present disclosure, each connecting beam may include a top wall, a bottom wall, an outer side wall and an inner side wall. As shown in FIG. 11 and FIG. 12, taking the first connecting beam 112 as an example, the first connecting beam 112 includes a top wall 112*a*, a bottom wall 112*b*, an outer side wall 112*c* and an inner side wall 112*d*, the outer side wall 112*c* and the inner side wall 112*d* are connected between the top wall 112*a* and the bottom wall 112*b*, the outer side wall 112*c* and the inner side wall 112*d* are spaced apart in outer and inner directions, and a connecting beam reinforcing rib 117 is also connected between the outer side wall 112*c* and the inner side wall 112*d*. The outer side wall 112*c* and the inner side wall 112*d* can ensure the connecting strength between the top wall 112*a* and the bottom wall 112*b*, so that the structural strength of the connecting beam can be enhanced. Furthermore, the connecting beam reinforcing rib 117 can further enhance the structural strength of the connecting beam, so that the structural strength of the bogie frame 100 can be better improved, and the bogie frame 100 can better secure the electric assembly 300.

As shown in FIG. 4 and FIG. 6, the top wall 112*a* of the first connecting beam 112 and the top wall of the third connecting beam 114 can be connected between the top wall of the second connecting beam 113 and the top wall of the fourth connecting beam 115 in an arc shape. Thus, the top wall of the fourth connecting beam 115 is in smooth connection and transition with the top wall of the second connecting beam 113 under the condition that the top wall of the fourth connecting beam 115 is higher than the top wall of the second connecting beam 113, so that the bogie body 110 can better secure the electric assembly 300, and the bogie body 110 has strong structural bearing capacity and high strength under the same material weight. In some embodiments of the present disclosure, the bottom walls of the first connecting beam 112, the second connecting beam 113, the third connecting beam 114 and the fourth connecting beam 115 may be positioned on the same plane.

As shown in FIGS. 4, 6, 11 and 12, the top wall 112*a* of the first connecting beam 112, the top wall of the second connecting beam 113 and the top wall of the third connecting beam 114 may be of a split structure, the top wall of the fourth connecting beam 115 is divided into two sections positioned at two sides of the electric assembly mounting groove 102, and the two sections of the top wall of the fourth connecting beam 115 are integrally formed with the top wall 112*a* of the first connecting beam 112 and the top wall of the third connecting beam 114 respectively. Thus, the top wall 112*a* of the whole bogie frame 100 is reasonable in structure, the manufacturing difficulty of the bogie frame 100 can be reduced, and the manufacturing efficiency of the bogie assembly 1000 can be enhanced.

Figure 10:
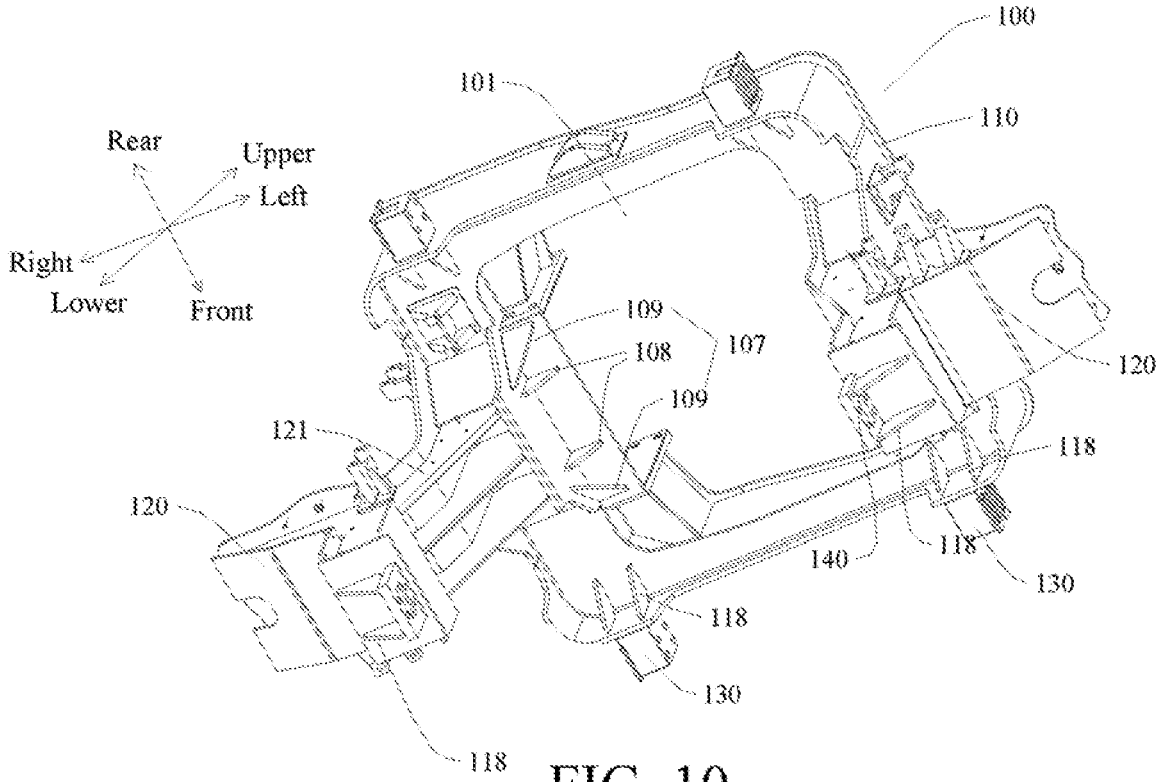
FIG. 10 is a three-dimensional view of the bogie frame.

As shown in FIG. 9 and FIG. 10, the end surface of the bottom wall of the electric assembly mounting groove 102 facing away from the electric assembly 300 may be provided with a reinforcing structure. The reinforcing structure can effectively enhance the structural strength of the bottom wall of the electric assembly mounting groove 102, so that the electric assembly mounting groove 102 can better secure the electric assembly 300.

As shown in FIG. 9 and FIG. 10, the reinforcing structure may be a plurality of reinforcing ribs 107, and the plurality of reinforcing ribs 107 of the electric assembly mounting groove 102 may be spaced apart. For example, the plurality of reinforcing ribs 107 of the electric assembly mounting groove 102 may include vertical reinforcing ribs 108 and inclined reinforcing ribs 109, the vertical reinforcing ribs 108 may be perpendicular to the bottom wall of the electric assembly mounting groove 102, and the inclined reinforcing ribs 109 may be obliquely arranged relative to the bottom wall of the electric assembly mounting groove 102. Thus, the vertical reinforcing rib 108 can better enhance the structural strength of the bottom wall of the electric assembly mounting groove 102 in the up-and-down direction, and the inclined reinforcing rib 109 can better enhance the structural strength of the bottom wall of the electric assembly mounting groove 102 in the up-and-down direction and the front-and-rear direction, so that the reliability of the electric assembly 300 mounted in the electric assembly mounting groove 102 can be enhanced.

Specifically, as shown in FIG. 9, two vertical reinforcing ribs 108 and two inclined reinforcing ribs 109 may be respectively arranged, the two vertical reinforcing ribs 108 are arranged between the two inclined reinforcing ribs 109, and the two inclined reinforcing ribs 109 are respectively arranged close to two edges of the bottom wall of the electric assembly mounting groove 102.

As shown in FIG. 10, the bogie frame 100 may be provided with a horizontal wheel mounting seat, and the horizontal wheel mounting seat can be used for mounting a horizontal wheel, wherein the horizontal wheel may include a guide wheel 500 and a steady wheel 600, and correspondingly, the horizontal wheel mounting seat may include a guide wheel mounting seat 130 and a steady wheel mounting seat 140. The bogie frame 100 is also provided with a horizontal wheel mounting seat reinforcing rib 118 corresponding to the horizontal wheel mounting seat, and the horizontal wheel mounting seat reinforcing rib 118 may include a guide wheel mounting seat reinforcing rib and a steady wheel mounting seat reinforcing rib. As shown in FIG. 10, two guide wheel mounting seat reinforcing ribs are arranged at the guide wheel mounting seat 130, and two steady wheel mounting seat reinforcing ribs are arranged at the steady wheel mounting seat 140.

Figure 8:
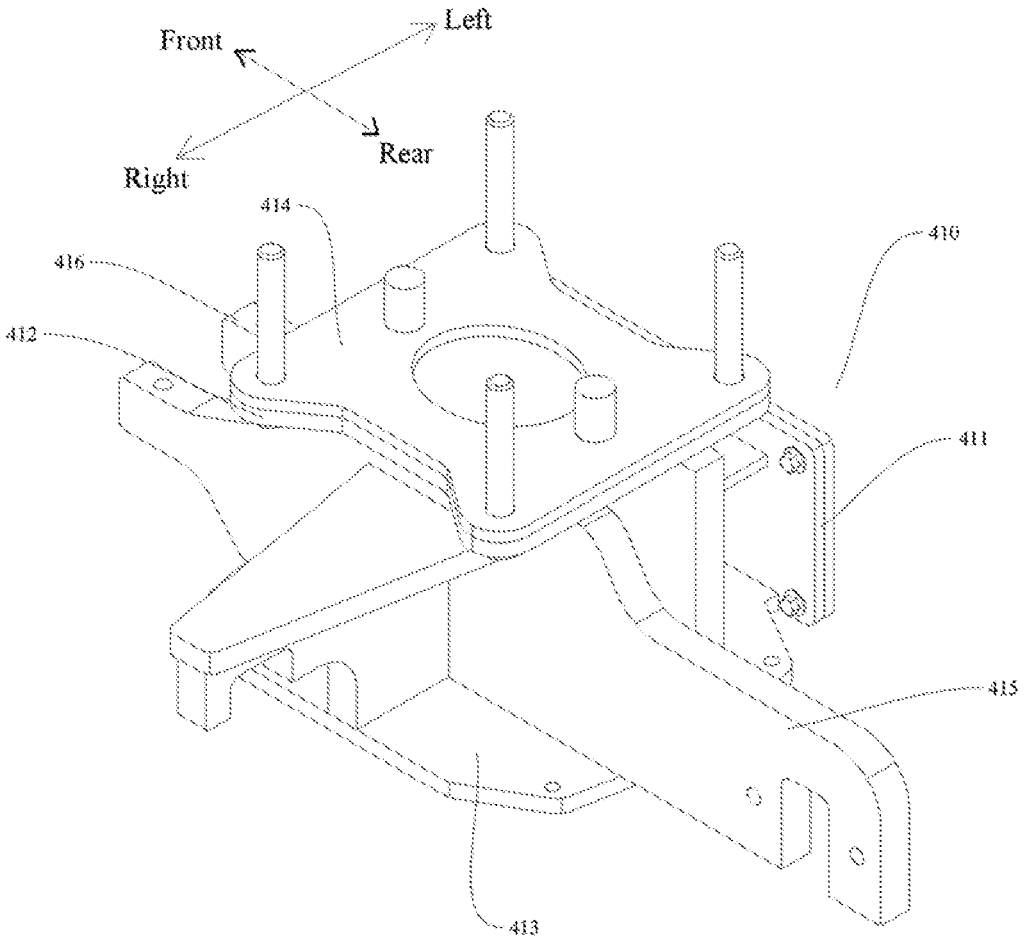
FIG. 8 is a three-dimensional view of a vehicle body connecting seat.

As shown in FIGS. 4 and 8, the bogie body 110 may be provided with a transverse stop mounting seat 111, the suspension system 400 mounted on the suspension support seat 120 is provided with a suspension stop component 411, and the suspension stop component 411 corresponds to and is suitable for being matched with the transverse stop mounting seat 111. Specifically, the transverse stop mounting seat 111 and the suspension stop component 411 are arranged oppositely, so that when the suspension system 400 offsets toward the bogie body 110, the suspension stop component 411 abuts against the transverse stop mounting seat 111, so that collision between the suspension system 400 and the bogie body 110 can be avoided, the suspension system 400 can be quickly reset, the inclining tendency of the rail vehicle can be eliminated, and further the structural reliability of the bogie assembly 1000 can be enhanced, and the service life of the bogie assembly 1000 can be prolonged.

As shown in FIG. 4, the suspension support seat 120 is substantially in a horizontal state, and smooth transition is adopted between the bogie body 110 and the suspension support seat 120, so that the transition between the bogie body 110 and the suspension support seat 120 is smooth, the connection between the bogie body 110 and the suspension support seat 120 is reliable, and further, the structural reliability of the bogie frame 100 can be enhanced. The bottom of the suspension support seat 120 may also be provided with a reinforcing plate connected to the bottom of the bogie body 110. In addition, by virtue of smooth transition between the bogie body 110 and the suspension support seat 120, a sufficient insulation gap can be formed between the suspension system 400 and the rail beam 3000 so as to be used for insulation between the rail beam 3000 and a conductor rail, so that the structural reliability of the bogie assembly 1000 can be enhanced.

As shown in FIG. 10, the lower surface of the connected portion between each suspension support seat 120 and the bogie body 110 may be provided with a plurality of connecting reinforcing ribs 121 spaced apart. Each connecting reinforcing rib 121 extends along the connecting direction between the bogie body 110 and the suspension support seat 120, i.e., from the bogie body 110 to the suspension support seat 120, so that the connecting reinforcing ribs 121 can enhance the connecting strength between the bogie body 110 and the suspension support seat 120 at least to some extent, and further, the structural reliability of the bogie frame 100 can be enhanced.

The suspension system 400 is described in detail below.

Figure 3:
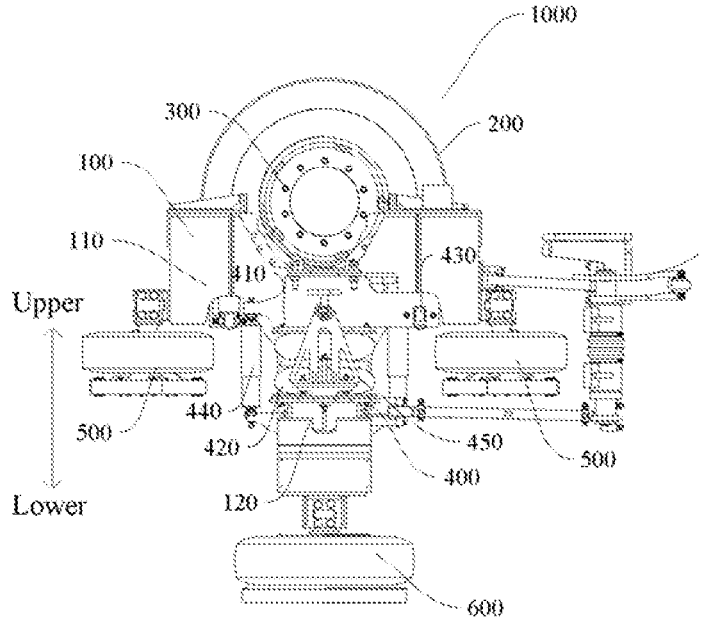
FIG. 3 is a side view of the bogie assembly according to the embodiments of the present disclosure.

As shown in FIG. 3 and FIG. 6, the suspension system 400 may include a vehicle body connecting seat 410, an elastic component 420, a transverse damper 430, a vertical damper 440 and an elastic component restrict bracket 450, the vehicle body connecting seat 410 is positioned above the suspension support seat 120, the vehicle body connecting seat 410 may be fixedly connected to the vehicle body 2000, and the elastic component 420 is connected between the vehicle body connecting seat 410 and the suspension support seat 120. In other words, the upper end of the elastic component 420 is connected to the vehicle body connecting seat 410, and the lower end of the elastic component 420 is connected to the suspension support seat 120. The transverse damper 430 is hinged between the vehicle body connecting seat 410 and the bogie body 110, the vertical damper 440 extends along the up-and-down direction, and the vertical damper 440 is hinged between the vehicle body connecting seat 410 and the suspension support seat 120. The elastic component restrict bracket 450 is connected between the vehicle body connecting seat 410 and the suspension support seat 120. Thus, the elastic component 420, the transverse damper 430 and the vertical damper 440 can ensure the stability of the rail vehicle in the traveling process along the up-and-down direction, the left-and-right direction and the front-and-rear direction together, and the suspension system 400 can achieve damping and buffering effects, so that vibration or bumpiness of the rail vehicle in the traveling process can be reduced, and the traveling noise of the rail vehicle can be reduced.

Each of the hinging mode between the transverse damper 430 and the bogie body 110, the hinging mode between the transverse damper 430 and the vehicle body connecting seat 410, the hinging mode between the vertical damper 440 and the vehicle body connecting seat 410 and the hinging mode between the vertical damper 440 and the suspension support seat 120 is a spherical hinge, so that the damping effect of the suspension system 400 can be enhanced, and the phenomenon of stress concentration can be prevented so as to enhance the reliability of the suspension system 400.

In some embodiments of the present disclosure, two suspension systems 400 may be provided and symmetrically arranged with respect to the center of the bogie frame 100. That is, in the horizontal plane, one suspension system 400 rotates for 180° around the center of the bogie frame 100 to obtain another suspension system 400 so as to prevent the vehicle body 2000 from twisting in the horizontal plane, so that the stability of the rail vehicle in the traveling process can be enhanced.

For reasonable construction of the suspension system 400 and better operation of the transverse damper 430 and the vertical damper 440, the transverse damper 430 and the vertical damper 440 may be respectively positioned at two sides of the elastic component 420. According to the embodiment as shown in FIG. 6, the bogie body 110 may be provided with an dodging groove 116 for avoiding the transverse damper 430. Thus, the arrangement of the transverse damper 430 is simple and reasonable, and the transverse damper 430 is reliably connected between the vehicle body connecting seat 410 and the bogie body 110.

Further, the elastic component restrict bracket 450 is hinged to the vehicle body connecting seat 410, and the elastic component restrict bracket 450 is fastened and connected to the suspension support seat 120 through a fastener. As shown in FIGS. 3 and 6, the upper end of the elastic component restrict bracket 450 is hinged to the vehicle body connecting seat 410 to avoid the phenomenon of stress concentration, so that rigid fracture of the elastic component restrict bracket 450 can be avoided to ensure the structural reliability of the suspension system 400. The elastic component restrict bracket 450 can effectively protect the elastic component 420 to prevent excessive deformation of the elastic component 420, so that the service life of the elastic component 420 can be prolonged. In some embodiments of the present disclosure, the elastic component 420 may be an air spring or a hourglass spring.

Figure 7:
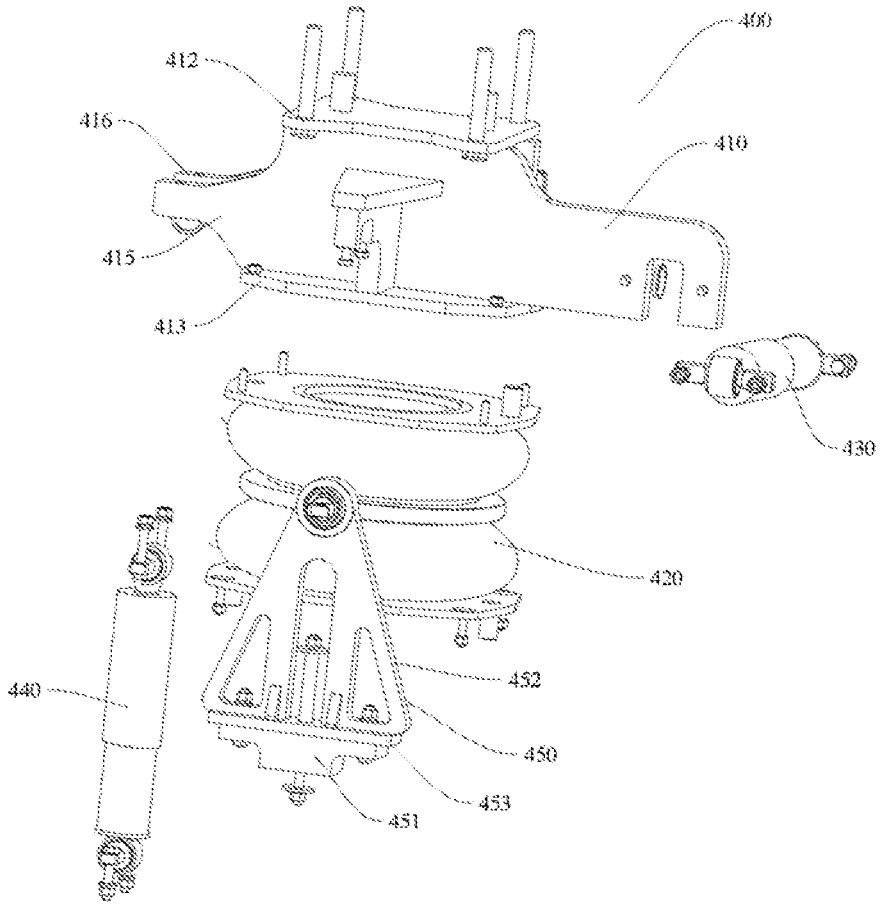
FIG. 7 is an exploded view of the suspension system.

As shown in FIG. 7 and FIG. 8, the vehicle body connecting seat 410 may include an upper plate 412, a lower plate 413 and a web plate, the web plate is vertically connected between the upper plate 412 and the lower plate 413, the upper plate 412 is suitable for being connected to the vehicle body 2000, the lower plate 413 is suitable for being fixedly connected to the upper end of the elastic component 420, and the surface of the upper plate 412 facing the vehicle body 2000 is provided with a buffer cushion 414. The buffer cushion 414 can achieve damping and buffering effects between the vehicle body 2000 and the suspension system 400, so that vibration of the rail vehicle in the traveling process can be reduced, and the noise of the rail vehicle in the traveling process can be reduced. The buffer cushion 414 may be a rubber cushion. As shown in FIG. 8, the shape of the buffer cushion 414 is the same as the shape of the upper plate 412. Thus, on the one hand, the buffer cushion 414 can achieve a reliable buffering effect between the vehicle body 2000 and the upper plate 412, and on the other hand, the buffer cushion 414 and the upper plate 412 can be fastened simply and reliably.

The web plate may be used for being connected to other components in the suspension system 400, and there may be a plurality of web plates arranged in parallel. On the one hand, the plurality of web plates can enhance the connecting strength between the upper plate 412 and the lower plate 413, and on the other hand, the plurality of web plates are convenient to be fixedly connected to other components in the suspension system 400. Specifically, as shown in FIG. 8, there are two web plates including a long web plate 415 and a short web plate 416 with different lengths respectively, the extended length of the long web plate 415 is greater than the extended length of the short web plate 416, one end (rear end in FIG. 8) of the long web plate 415 is hinged to the transverse damper 430, the other end (front end in FIG. 8) of the long web plate 415 and one end (front end in FIG. 8) of the short web plate 416 are both hinged to the vertical damper 440, and the front end of the long web plate 415 is adjacent to the front end of the short web plate 416. Thus, the connecting reliability between the transverse damper 430 and the vertical damper 440 and the vehicle body connecting seat 410 can be ensured.

In addition, as shown in FIG. 8, the surface of the short web plate 416 facing away from the long web plate 415 is provided with the suspension stop component 411. When the vehicle body shakes left and right, the suspension stop component 411 and the transverse stop mounting seat 111 are mutually abutted so as to stabilize the vehicle body 2000. The suspension stop component 411 may include the rubber cushion. The rubber cushion can buffer collision between the suspension stop component 411 and the transverse stop mounting seat 111 so as to enhance the structural reliability of the bogie assembly 1000.

As shown in FIG. 8, the surface of the long web plate 415 facing away from the short web plate 416 may be provided with a restrict bracket mounting plate, and the elastic component restrict bracket 450 is hinged on the restrict bracket mounting plate.

In some embodiments of the present disclosure, the upper plate 412, the web plate and the lower plate 413 may be in welded connection. Thus, the structural integrity of the vehicle body connecting seat 410 is better, the mounting method of the vehicle body connecting seat 410 is simple, and the mounting efficiency of the vehicle body connecting seat 410 is high.

Figure 15:
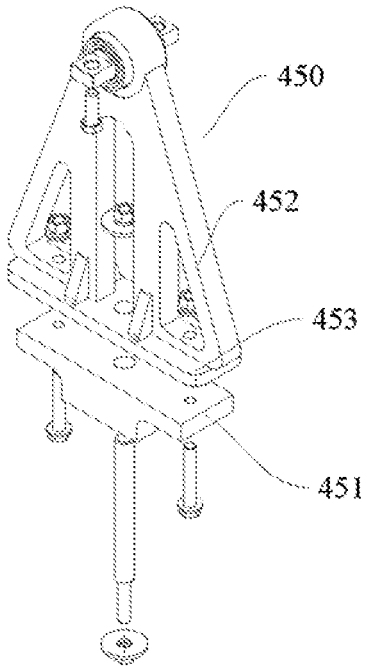
FIG. 15 is a schematic of an elastic component restrict bracket.

As shown in FIG. 15, the lower end of the elastic component restrict bracket 450 may be provided with a damping cushion 451, and the damping cushion 451 and the suspension support seat 120 are fastened, for example, through a fastener. Specifically, the fastener can sequentially penetrate through the suspension support seat 120 and the damping cushion 451 of the elastic component restrict bracket 450 so as to fix the damping cushion 451 and the suspension support seat 120. By setting the damping cushion 451, rigid collision and impact between the suspension support seat 120 and the elastic component restrict bracket 450 can be reduced, so that the structural reliability of the bogie assembly 1000 can be enhanced, and the noise generated between the suspension support seat 120 and the elastic component restrict bracket 450 can be reduced. In some embodiments of the present disclosure, the damping cushion 451 of the elastic component restrict bracket 450 may be the rubber cushion.

As shown in FIG. 15, part of the damping cushion 451 of the elastic component restrict bracket 450 protrudes to form a bulge, and a groove matched with the bulge is formed in the suspension support seat 120. The bulge can be matched in the groove, thus on the one hand, the assembly between the damping cushion 451 of the elastic component restrict bracket 450 and the suspension support seat 120 can be facilitated, and on the other hand, the damping effect of the damping cushion 451 of the elastic component restrict bracket 450 can be enhanced so as to better reduce the noise generated by the bogie assembly 1000.

The elastic component restrict bracket 450 may be substantially triangular, the vertex of the elastic component restrict bracket 450 is hinged to the vehicle body connecting seat 410, and the bottom edge of the elastic component restrict bracket 450 is provided with a plurality of mounting holes for fasteners to penetrate through. The connecting area between the bottom edge of the elastic component restrict bracket 450 and the suspension support seat 120 is large, so that the stress of all parts is uniform, the connecting reliability between the elastic component restrict bracket 450 and the suspension support seat 120 can be enhanced, and further, the structural reliability of the bogie assembly 1000 can be enhanced.

The elastic component restrict bracket 450 can be configured to be of a plate structure, and the elastic component restrict bracket 450 may be provided with a fastener dodging hole. Thus, the fastener can conveniently extend into the corresponding mounting hole, and the fastener dodging hole can also reduce the weight of the elastic component restrict bracket 450 at least to some extent so as to enable the rail vehicle to meet the requirement for light weight.

Specifically, as shown in FIG. 15, the elastic component restrict bracket 450 may include a restrict component body 452 and a restrict component bottom plate 453, the upper end of the restrict component body 452 is hinged to the vehicle body connecting seat 410, the restrict component bottom plate 453 is connected to the restrict component body 452, and the restrict component bottom plate 453 is provided with a mounting hole. The restrict component bottom plate 453 corresponds to the damping cushion 451, so that the damping cushion 451 can achieve a damping effect between the restrict component bottom plate 453 and the suspension support seat 120.

In addition, as shown in FIG. 15, a support column is connected between the restrict component body 452 and the restrict component bottom plate 453. The support column can enhance the structural strength of the elastic component restrict bracket 450 at least to some extent and can prolong the service life of the elastic component restrict bracket 450.

The elastic component restrict bracket 450 can be arranged at the side of the suspension system 400 away from the bogie body 110. Thus, the position of the elastic component restrict bracket 450 is reasonable, so that the structural integrity of the suspension system 400 is better, and the structural stability of the bogie assembly 1000 can be enhanced.

The horizontal wheel is described in detail below. The horizontal wheel includes a guide wheel 500 and a steady wheels 600.

The bogie frame 100 is provided with a horizontal wheel mounting seat, the horizontal wheel mounting seat may include a guide wheel mounting seat 130 and a steady wheel mounting seat 140, the guide wheel mounting seat 130 corresponds to the guide wheel 500, and the steady wheel mounting seat 140 corresponds to the steady wheel 600. The guide wheel mounting seat 130 may be arranged on the bogie body 110. For example, the guide wheel mounting seat 130 may be arranged on the first connecting beam 112 and the third connecting beam 114. Specifically, the first connecting beam 112 may be provided with two guide wheel mounting seats 130 spaced apart, and the third connecting beam 114 may be provided with two guide wheel mounting seats 130 spaced apart. The steady wheel mounting seat 140 may be arranged at the bottom of the suspension support seat 120, and each suspension support seat 120 corresponds to one steady wheel mounting seat 140.

The horizontal wheel is detachably mounted on the horizontal wheel mounting seat. For example, the horizontal wheel may be fixedly connected to the corresponding horizontal wheel mounting seat through a fastener, and there may be a plurality of fasteners so as to ensure the fixed reliability between the horizontal wheel and the horizontal wheel mounting seat.

As shown in FIGS. 2, 3, 13 and 14, the bogie assembly 1000 may also include an adjusting shim, and the adjusting shim is inserted between the horizontal wheel and the horizontal wheel mounting seat. The adjusting shim may include a guide wheel adjusting shim 510 and a steady wheel adjusting shim, the guide wheel adjusting shim 510 is inserted between the guide wheel 500 and the guide wheel mounting seat 130, and the steady wheel adjusting shim may be arranged between the steady wheel 600 and the steady wheel mounting seat 140. It can be understood that during the traveling of the rail vehicle, the peripheral surfaces of the steady wheel 600 and the guide wheel 500 abut against the rail beam 3000 all the time, so that the steady wheel 600 and the guide wheel 500 are in a worn state all the time until the gap between the steady wheel 600 and the rail beam 3000 is formed and the gap between the guide wheel 500 and the rail beam 3000 is formed. In this case, the effects of the steady wheel 600 and the guide wheel 500 are reduced or even gradually lost, so that the distance between the steady wheel 600 and the rail beam 3000 need to be adjusted to eliminate the gaps and the distance between the guide wheel 500 and the rail beam 3000 also need to be adjusted to eliminate the gaps. Under such condition, the corresponding adjusting shim can be dismounted to reduce the distance between the center of the steady wheel 600 and the rail beam 3000 and reduce the distance between the center of the guide wheel 500 and the rail beam 3000, so that the steady wheel 600 and the guide wheel 500 can be kept in contact with the rail beam 3000 respectively, keeping the effects of the steady wheel 600 and the guide wheel 500. In some embodiments of the present disclosure, there may be a plurality of adjusting shims, and one adjusting shim can be dismounted in each adjustment so as to enable the steady wheel 600 and the guide wheel 500 to be kept in contact with the rail beam 3000 without replacing the guide wheel 500 and the steady wheel 600.

Figure 2:
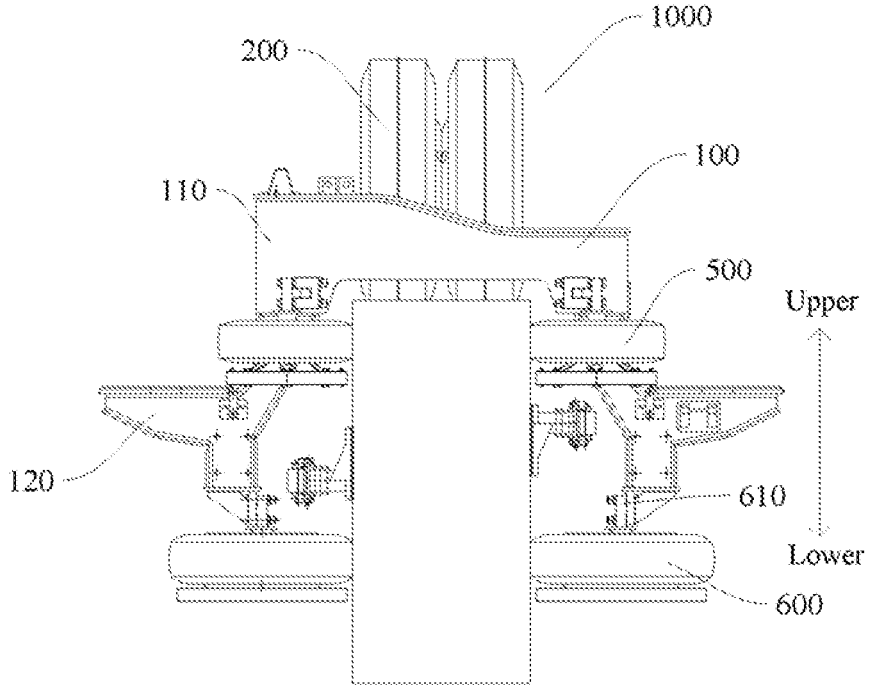
FIG. 2 is a front view of the bogie assembly and the rail beam according to the embodiments of the present disclosure.
Figure 13:
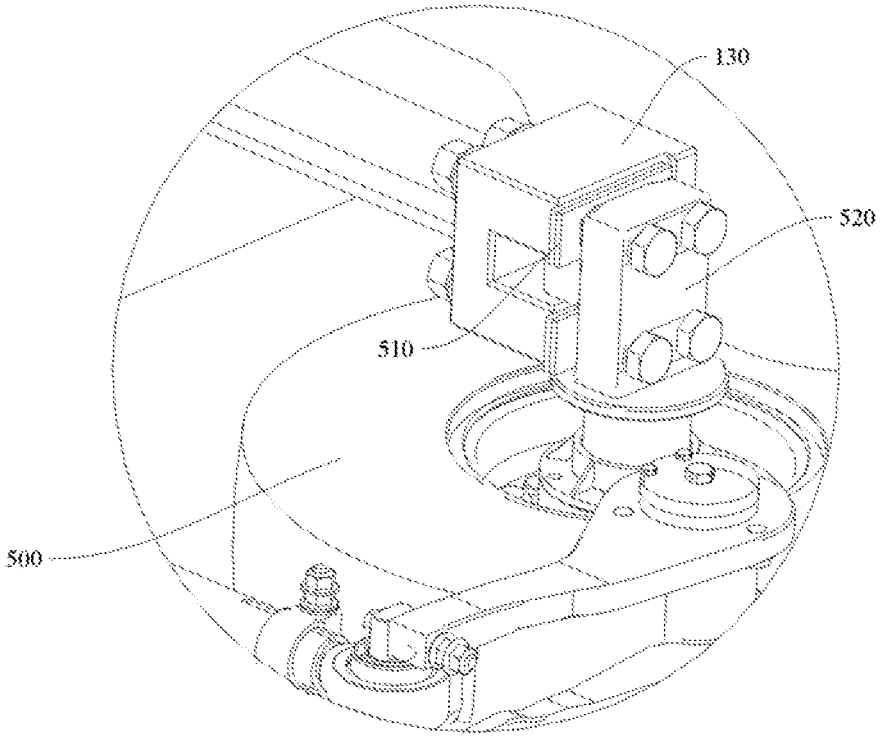
FIG. 13 is an enlarged view of a region A in FIG. 1.

A mounting block is arranged on the horizontal wheel and is fixed onto the horizontal wheel mounting seat through a fastener so as to fix the horizontal wheel onto the horizontal wheel mounting seat, and the fastener penetrates through the adjusting shim. In some embodiments of the present disclosure, the guide wheel 500 may be provided with a guide wheel mounting block 520, and the steady wheel 600 may be provided with a steady wheel mounting block 610. As shown in FIG. 13, the fastener sequentially penetrates through the guide wheel mounting block 520, the guide wheel adjusting shim 510 and the guide wheel mounting seat 130 so as to fix the three components together, so that the guide wheel 500 can be fixed on the bogie body 110. Similarly, as shown in FIG. 2, the fastener sequentially penetrates through the steady wheel mounting block 610, the steady wheel adjusting shim and the steady wheel mounting seat 140 so as to fix the three components together, so that the steady wheel 600 can be fixed at the bottom of the suspension support seat 120.

Figure 14:
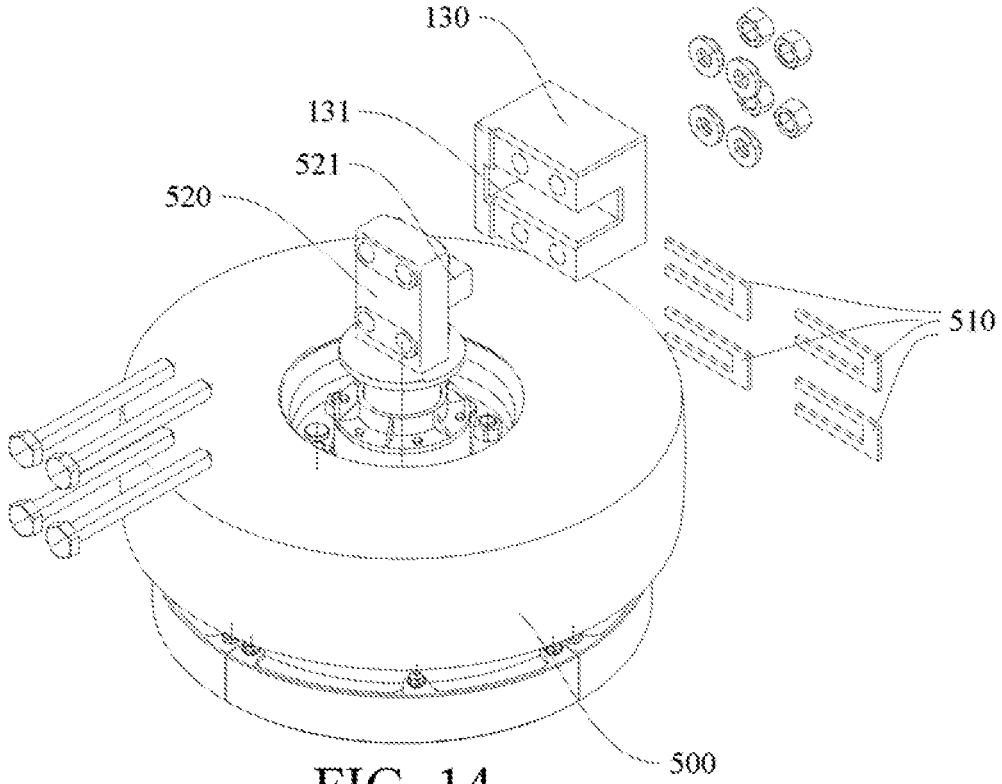
FIG. 14 is an exploded view of the guide wheel and the guide wheel mounting seat.

In some embodiments of the present disclosure, the mounting block may be provided with a first pre-positioning component, the horizontal wheel mounting seat may be provided with a second pre-positioning component, and the first pre-positioning component is suitable for being matched with the second pre-positioning component. As shown in FIG. 14, taking the guide wheel mounting block 520 as an example, the guide wheel mounting block 520 may be provided with a first pre-positioning component 521, the guide wheel mounting seat 130 may be provided with a second pre-positioning component 131, and the first pre-positioning component 521 is suitable for being matched with the second pre-positioning component 131. In the mounting process of the guide wheel 500, the first pre-positioning component 521 may be pre-matched with the second pre-positioning component 131 to achieve a pre-positioning mounting between the guide wheel mounting block 520 and the guide wheel mounting seat 130, so that the guide wheel mounting block 520 and the guide wheel mounting seat 130 can be conveniently fixed through the fastener, and further, the mounting efficiency of the guide wheel 500 can be enhanced.

Similarly, in the mounting process of the steady wheel 600, the first pre-positioning component of the steady wheel mounting block 610 may be pre-matched with the second pre-positioning component of the steady wheel mounting seat 140 to achieve a pre-positioning mounting between the steady wheel mounting block 610 and the steady wheel mounting seat 140, so that the steady wheel mounting block 610 and the steady wheel mounting seat 140 can be conveniently fixed through the fastener, and further, the mounting efficiency of the steady wheel 600 can be enhanced.

In some embodiments of the present disclosure, one of the first pre-positioning component and the second pre-positioning component is a bulge, the other one is a groove, and the bulge is suitable for being matched with the groove. For example, as shown in FIG. 14, the first pre-positioning component 521 of the guide wheel mounting block 520 may be a bulge, the second pre-positioning component 131 of the guide wheel mounting seat 130 may be a groove, and the bulge may extend into the groove in advance so as to achieve pre-positioning of the guide wheel mounting seat 130 to the guide wheel mounting block 520 in the up-and-down direction, so that the guide wheel mounting block 520 and the corresponding guide wheel mounting seat 130 can be conveniently fixed through the fastener. Similarly, the first pre-positioning component of the steady wheel mounting block 610 and the second pre-positioning component of the steady wheel mounting seat 140 also have the similar structures, and the descriptions thereof are omitted herein.

An dodging groove for avoiding a fastener is formed in the adjusting shim, and one end of the dodging groove is opened. It can be understood that in the process of dismounting the adjusting shim, the fastener does not need to be completely removed from the mounting block and the horizontal wheel mounting seat, and the fastener may be unscrewed to release the mounting block and the horizontal wheel mounting seat to enable the adjusting shim to have an activity gap, so that a worker can dismount one of the plurality of adjusting shims by using a tool and then tighten the fastener. By forming the dodging groove in the adjusting shim, the adjusting shim can be dismounted simply and conveniently, so that the reliability of the guide wheel 500 and the steady wheel 600 can be better enhanced.

In some embodiments of the present disclosure, fasteners may be arranged above and below the first pre-positioning components (the first pre-positioning component 521 of the guide wheel mounting block 520 and the first pre-positioning component of the steady wheel mounting block 610), and the numbers of the adjusting shims above and below the first pre-positioning components are identical.

At one side of the rail beam 3000, the steady wheel 600 is positioned between two guide wheels 500. For example, each side of the rail beam 3000 may be provided with one steady wheel 600 and two guide wheels 500, the two guide wheels 500 are respectively arranged on the first connecting beam 112 and the third connecting beam 114, and the steady wheel 600 is positioned on the suspension support seat 120 below the second connecting beam 113 or the fourth connecting beam 115. Thus, in the front-and-rear direction, the steady wheel 600 is positioned between the two guide wheels 500, and in the up-and-down direction, the steady wheel 600 is lower than the two guide wheels 500. By the reasonable arrangement of the guide wheel 500 and the steady wheel 600, the traveling stability of the rail vehicle is better.

The diameter of the steady wheel 600 may be greater than the diameter of the guide wheel 500, so that the body stability of the vehicle in traveling and turning processes can be enhanced. The central axis of the steady wheel 600 is positioned at the outer side of the central axis of the guide wheel 500, wherein the outer and inner sides are defined according to the distances from the rail beam 3000. Thus, the steady wheel 600 and the guide wheel 500 can be tightly matched to the rail beam 3000, and the steady wheel 600 and the guide wheel 500 can ensure that a sufficient insulation space is reserved between the bogie frame 100 and the rail beam 3000. Such that, the insulation space can ensure insulation between the rail beam 3000 and the conductor rail and can ensure insulation between the conductor rail and the bogie frame 100, thereby further enhancing the traveling safety of the rail vehicle.

As shown in FIG. 2, there may be four guide wheels 500, and there may be two steady wheels 600. The four guide wheels 500 may be positioned at the same height, and the two steady wheels 600 are positioned at another same height and symmetrically arranged with respect to the rail beam 3000, and the height of the steady wheel 600 is less than the height of the guide wheel 500. Thus, the structural reliability of the rail vehicle can be enhanced, and the four guide wheels 500 and the two steady wheels 600 can ensure the traveling safety of the rail vehicle.

The rail vehicle according to the embodiments of the present disclosure includes the bogie assembly 1000 described in the above embodiments.

In the descriptions of this specification, descriptions such as reference terms "an embodiment", "some embodiments", "example", "specific example", or "some examples" intend to indicate that specific features, structures, materials, or characteristics described with reference to embodiments or examples are included in at least one embodiment or example of the present disclosure. In this specification, schematic descriptions of the foregoing terms do not need to aim at a same embodiment or example. Besides, the specific features, the structures, the materials or the characteristics that are described may be combined in a proper manner in any one or more embodiments or examples. In addition, in a case that is not mutually contradictory, persons skilled in the art can combine or group different embodiments or examples that are described in this specification and features of the different embodiments or examples.

Although the embodiments of the present disclosure are shown and described above, it may be understood that the foregoing embodiments are examples, and cannot be understood as limitations to the present disclosure. A person of ordinary skill in the art may make changes, modifications, replacements, and variations to the foregoing embodiments without departing from the scope of the present disclosure.

What is claimed is:

1. A bogie frame, comprising:

a bogie body being substantially rectangular and comprising a first connecting beam, a second connecting beam, a third connecting beam and a fourth connecting beam which are sequentially connected end to end, wherein the first connecting beam is opposite to the third connecting beam, the second connecting beam is opposite to the fourth connecting beam, wherein the fourth connecting beam has an electric powertrain assembly mounting groove, a thickness of the fourth connecting beam is greater than a thickness of the second connecting beam, and a top wall of the first connecting beam and a top wall of the third connecting beam are in an arc shape and are connected between a top wall of the second connecting beam and a top wall of the fourth connecting beam.

2. The bogie frame according to claim 1, wherein each of the first connecting beam, the second connecting beam, the third connecting beam and the fourth connecting beam comprises an outer side wall and an inner side wall, the outer side wall and the inner side wall connect the top wall and a bottom wall and are spaced apart in inward directions, and a connecting beam reinforcing rib is connected between the outer side wall and the inner side wall.

3. The bogie frame according to claim 2, wherein the top wall of the first connecting beam, the top wall of the second connecting beam and the top wall of the third connecting beam are of a split structure, the top wall of the fourth connecting beam comprises two sections positioned at two sides of the electric powertrain assembly mounting groove, and the two sections of the top wall of the fourth connecting beam are integrated with the top wall of the first connecting beam and the top wall of the third connecting beam respectively.

4. The bogie frame according to claim 1, further comprising two suspension support seats substantially in a horizontal level and connected to two opposite sides of the bogie body respectively, wherein transitions between the bogie body and the suspension support seats are smooth, and a rail recess is defined by the suspension support seats and the bogie body.

5. The bogie frame according to claim 4, wherein the two suspension support seats are respectively connected to the second connecting beam and the fourth connecting beam, a plurality of connecting reinforcing ribs are spaced apart on the lower surface of a connection between the suspension support seats and the bogie body, the distance between the upper surface of the second connecting beam and the upper surface of the corresponding suspension support seat is 480 millimeter (mm) to 660 mm, and the distance between the upper surface of the fourth connecting beam and the upper surface of the corresponding suspension support seat is 620 mm to 800 mm.

6. The bogie frame according to claim 1, further comprising a horizontal wheel mounting seat and a horizontal wheel mounting seat reinforcing rib on the bogie frame wherein the horizontal wheel mounting seat reinforcing rib is corresponding to the horizontal wheel mounting seat.

7. A bogie assembly, comprising a bogie frame comprising a suspension support seat connected to a bogie body, wherein:

the bogie body has a running wheel mounting groove, the bogie body has a first connecting beam and a third connecting beam with respective guide wheel mounting seats, a second connecting beam, and a fourth connecting beam, wherein the first connecting beam, the second connecting beam, the third connecting beam, and the fourth connecting beam are sequentially connected end to end, the fourth connecting beam includes an electric powertrain assembly mounting groove, a thickness of the fourth connecting beam is greater than a thickness of the second connecting beam, a top wall of the first connecting beam and a top wall of the third connecting beam are in an arc shape and are connected between a top wall of the second connecting beam and a top wall of the fourth connecting beam, and the suspension support seat has a steady wheel mounting seat.

8. The bogie assembly according to claim 7, further comprising:

a running wheel rotationally mounted in the running wheel mounting groove;

an electric powertrain assembly mounted in the electric powertrain assembly mounting groove, wherein the electric powertrain assembly drives the running wheel to rotate;

a suspension system mounted on the suspension support seat;

a guide wheel mounted on each of the guide wheel mounting seats;

a steady wheel mounted on the steady wheel mounting seat; and a traction mechanism connected between the bogie frame and a vehicle body, wherein the traction mechanism is configured to haul the vehicle body.

9. The bogie assembly according to claim 8, wherein the suspension support seat includes two suspension support seats that are respectively connected to the second connecting beam and the fourth connecting beam, the first connecting beam, the second connecting beam, the third connecting beam, the fourth connecting beam and the two suspension support seats define a rail recess, the suspension system includes two suspension systems that are symmetrically arranged with respect to the center of the bogie frame, and the two suspension systems correspond to the two suspension support seats respectively.

10. The bogie assembly according to claim 8, further comprising an axial restrict component and a radial restrict component arranged at the electric powertrain assembly mounting groove, wherein:

the electric powertrain assembly is fixed to the axial restrict component and the radial restrict component;

the axial restrict component is of a plate structure and is perpendicular to the axis of the electric powertrain assembly, the axial restrict component is substantially in a U shape, and a plurality of mounting holes are arranged in an extended direction of the axial restrict component; and the radial restrict component includes two radial restrict components that are of a plate structure, the two radial restrict components are respectively positioned at two sides of the electric powertrain assembly, and the two radial restrict components have mounting holes respectively.

11. The bogie assembly according to claim 8, wherein the suspension system comprises a vehicle body connecting seat, an elastic component, a transverse damper and a vertical damper, wherein the vehicle body connecting seat comprises an upper plate suitable for being connected to the vehicle body, a web plate positioned below the upper plate and connected to the upper plate, and a lower plate positioned below the web plate and connected to the web plate, wherein a buffer cushion is set up on a surface of the upper plate facing the vehicle body, and the vehicle body connecting seat is positioned above the suspension support seat, the elastic component is connected between the vehicle body connecting seat and the suspension support seat, the transverse damper is hinged between the vehicle body connecting seat and the bogie body, and the vertical damper is hinged between the vehicle body connecting seat and the suspension support seat.

12. The bogie assembly according to claim 11, wherein the web plate includes a long web plate and a short web plate with different lengths, one end of the long web plate is hinged to the transverse damper, the other end of the long web plate and one end of the short web plate are both hinged to the vertical damper, and the one end of the short web plate is adjacent to the other end of the long web plate.

13. The bogie assembly according to claim 12, further comprising a suspension stop component set up on a surface of the short web plate facing away from the long web plate, wherein the suspension stop component comprises a rubber cushion, and a transverse stop mounting seat set up on the bogie body, wherein the transverse stop mounting seat corresponds to the suspension stop component and is suitable for matching with the suspension stop component.

14. The bogie assembly according to claim 11, wherein the suspension system further comprises an elastic component restrict bracket, wherein the elastic component restrict bracket is connected between the vehicle body connecting seat and the suspension support seat, an upper end of the elastic component restrict bracket is hinged to the vehicle body connecting seat, a lower end of the elastic component restrict bracket is fixed to the suspension support seat through a fastener, a damping cushion is arranged at the lower end of the elastic component restrict bracket and is positioned between the elastic component restrict bracket and the suspension support seat, and the fastener penetrates through the damping cushion.

15. The bogie assembly according to claim 8, further comprising a reinforcing structure on an end surface of a bottom wall of the electric powertrain assembly mounting groove facing away from the electric powertrain assembly, wherein the reinforcing structure includes a plurality of reinforcing ribs.

16. The bogie assembly according to claim 15, wherein the plurality of reinforcing ribs comprises vertical reinforcing ribs and inclined reinforcing ribs, the vertical reinforcing ribs are perpendicular to the bottom wall of the electric powertrain assembly mounting groove, and the inclined reinforcing ribs are inclined with respect to the bottom wall of the electric powertrain assembly mounting groove.

17. The bogie assembly according to claim 16, wherein the vertical reinforcing ribs are two vertical reinforcing ribs and the inclined reinforcing ribs are two inclined reinforcing ribs, the two vertical reinforcing ribs are arranged between the two inclined reinforcing ribs, and the two inclined reinforcing ribs are arranged close to two edges of the bottom wall of the electric powertrain assembly mounting groove respectively.

18. The bogie assembly according to claim 8, further comprising a guide wheel adjusting shim arranged between the guide wheel and the guide wheel mounting seat, and a steady wheel adjusting shim arranged between the steady wheel and the steady wheel mounting seat.

19. The bogie assembly according to claim 8, wherein a height of the steady wheel is less than a height of the guide wheel, a diameter of the steady wheel is greater than a diameter of the guide wheel, and a central axis of the steady wheel is positioned at an outer side of a central axis of the guide wheel.

20. The bogie assembly according to claim 7, further comprising a rail vehicle, wherein the rail vehicle comprises:

the vehicle body; and the bogie assembly, wherein the vehicle body is mounted on the bogie assembly.

* * * * *